US006318464B1

(12) United States Patent
Mokrys

(10) Patent No.: US 6,318,464 B1
(45) Date of Patent: Nov. 20, 2001

(54) VAPOR EXTRACTION OF HYDROCARBON DEPOSITS

(75) Inventor: Igor J. Mokrys, Calgary (CA)

(73) Assignee: Vapex Technologies International, Inc., Calgary (CA)

( * ) Notice: Subject to any disclaimer, the term of this patent is extended or adjusted under 35 U.S.C. 154(b) by 0 days.

(21) Appl. No.: 09/347,850

(22) Filed: Jul. 9, 1999

(30) Foreign Application Priority Data

Jul. 10, 1998 (CA) ..... 2243105

(51) Int. Cl.[7] ..... E21B 43/17; E21B 43/22; E21B 47/00

(52) U.S. Cl. ..... 166/252.1; 166/266; 166/267; 166/268; 166/271; 166/305.1

(58) Field of Search ..... 166/50, 250.01, 166/250.15, 252.1, 266, 267, 268, 271, 705.1, 308

(56) References Cited

U.S. PATENT DOCUMENTS

| | | | | |
|---|---|---|---|---|
| 3,856,086 | * | 12/1974 | Braden, Jr. | 166/403 |
| 4,022,278 | * | 5/1977 | Allen | 166/401 X |
| 4,753,293 | * | 6/1988 | Bohn | 166/267 |
| 5,407,009 | | 4/1995 | Butler et al. | 166/266 |
| 5,607,016 | * | 3/1997 | Butler | 166/268 X |
| 5,899,274 | * | 5/1999 | Frauenfeld et al. | 166/305.1 X |

FOREIGN PATENT DOCUMENTS

| | | |
|---|---|---|
| 2108349 | 8/1996 | (CA) . |
| 2185837 | 3/1998 | (CA) . |

OTHER PUBLICATIONS

Butler R.M. and Mokrys I.J., 'A New Process (Vapex) for Recovering Heavy Oils Using Hot Water and Hydrocarbon Vapour', The Journal of Canadian Petroleum Technology, vol. 30, No. 1, 97–106, Jan.–Feb. 1991.

Butler R.M. and Mokrys I.J., 'Recovery of Heavy Oils Using Vapourized Hydro–carbon Solvents: Further Development of the Vapex Process', The Journal of Canadian Petroleum Technology, vol. 32, No. 6, 56–62, Jun. 1993.

Butler R.M. and Mokrys I.J., 'Closed–Looped Extraction Method for the Recovery of Heavy oils and bitumens Underlain by Aquifers: The Vapex Process', The Journal of Canadian Petroleum Technology, vol. 37, No. 4, 41–50, Apr. 1998.

Mokrys I.J. and Butler R.M., 'The Rise of Interfering Solvent Chambers: Solvent Analog Model of Steam–Assisted Gravity Drainage', The Journal of Canadian Petroleum Technology, Mar. 1993, vol. 32, No. 3, pp. 26–36.

Mokrys I.J. and Butler R.M., 'In Situ Upgrading of Heavy Oils and Bitumen by Propane Deasphalting: The Vapex Process', SPE 25452, Production Operations Symposium, Oklahoma City, OK, USA, Mar. 21–23, 1993.

Butler R.M., Mokrys I.J. and Das S.K., 'Solvent Requirement for Vapex Recovery', SPE 30293, International Heavy Oil Symposium, Calgary, Alberta, Canada, Jun. 19–21, 1995.

Yuan, Jian–Yang; Tremblay, Bernard and Babchin, Alex. 'A Wormhole–Network Model of Cold Production in Heavy Oil', SPE 54097, International Thermal Operations and Heavy Oil Symposium, Bakersfield, California, Mar. 17–19, 1999.

* cited by examiner

*Primary Examiner*—George Suchfield
(74) *Attorney, Agent, or Firm*—Stevens, Davis, Miller & Mosher, LLP

(57) ABSTRACT

An improved method for the recovery of hydrocarbons from a hydrocarbon deposit comprising the steps of introducing a diluent gas along a predominantly horizontal injection well drilled at the base of a hydrocarbon deposit; creating an initial communication path with a predominantly horizontal production well spaced laterally apart from the injection well; gradually enriching the diluent gas with a hydrocarbon solvent to produce a hydrocarbon solvent vapor which is saturated at reservoir conditions; continuously circulating the diluent gas and the saturated hydrocarbon solvent vapor through the hydrocarbon deposit; and producing mobilized hydrocarbons from the hydrocarbon deposit.

33 Claims, 10 Drawing Sheets i. SIMPLE VAPEX
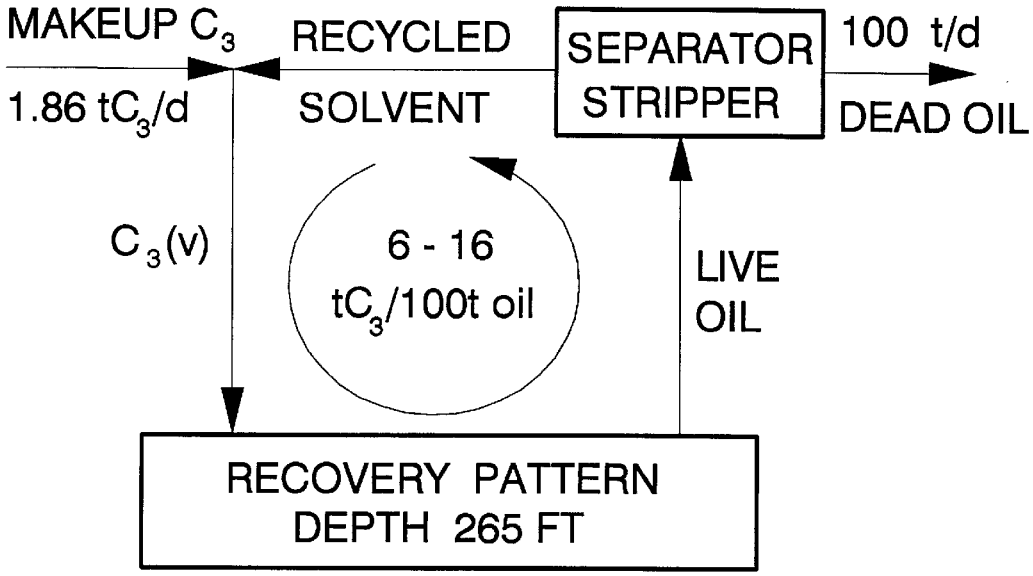
ii. RASD - VAPEX
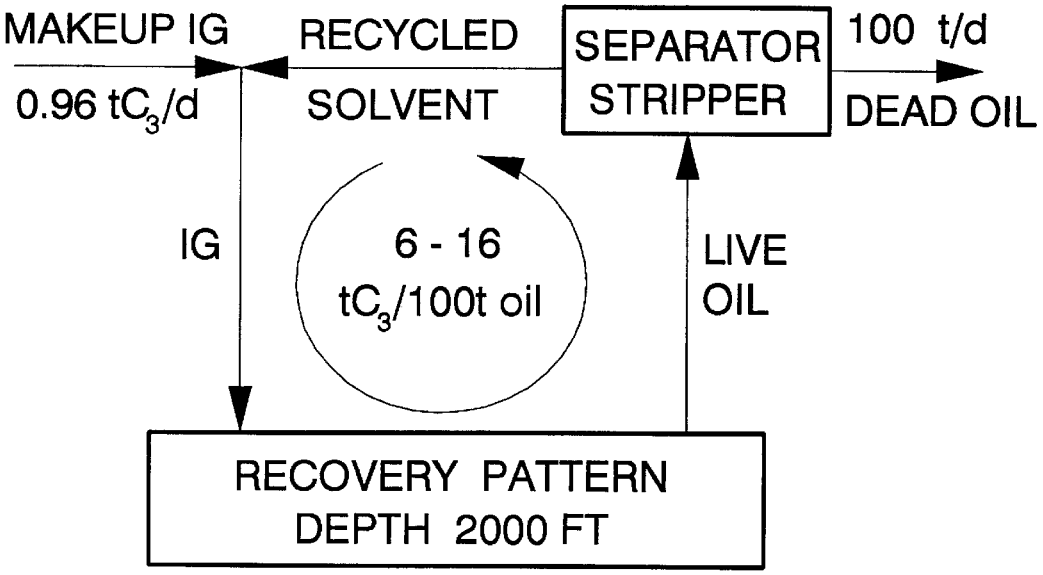
FIG.10 SOLVENT RECYCLE AND MAKEUP

VAPOR EXTRACTION OF HYDROCARBON DEPOSITS

FIELD OF THE INVENTION

Most petroleum reservoirs in Alberta and Saskatchewan are 800 to 2,100 ft deep and many are much deeper. While in Simple Vapex saturated propane vapour can only be injected into a reservoir up to 250–300 ft deep before it liquifies and becomes ineffective, in RASD-Vapex this limitation placed on reservoir depth is removed. This invention takes the Hydrocarbon Vapour in situ Recovery Process (Simple Vapex) one step further by making the solvent dewpoint adjustable to reservoir conditions. Reservoir Adjusted Solvent Dewpoint (RASD) makes Vapex completely flexible and opens up a wide applicability for the process in hydrocarbon deposits with reservoir pressures substantially higher than the dewpoint of pure solvent vapour. This was not possible with Simple Vapex. As a result, deep reservoirs that have been unrecoverable using current technologies, such as thin, underlain by active aquifers or those produced by cold flow with sand production that left behind high permeability channels and cavities, can now be economically produced.

KEY WORDS

Non-thermal miscible recovery, injection gas, tail gas, vaporized hydrocarbon solvent(s), dew point composition, saturated vapour, surface facility, solvent injector, mixing at downhole reservoir conditions, heavy oil, bitumen, high permeability zones, cold flow channels, fractures, active aquifers, horizontal wells.

BACKGROUND OF THE INVENTION

Many unconsolidated heavy oil sands reservoirs in east-central Alberta and west-central Saskatchewan (the Mannville group reservoirs) have been produced under primary production by bottom water drive, using arrays of long horizontal wells drilled at the top of the reservoir. These reservoirs are typically thin, up to 1,000 m deep, may be capped by a layer of gas and underlain by an active aquifer. Oil is produced by pumping and water displaces the oil as it rises from aquifers at the base of the reservoir. Since only a relatively small volume of the reservoir is affected by conventional vertical wells, the burgeoning use of long horizontal wells with much larger reservoir contact has in the past few years improved production rates and early economics, but not recovery. Cumulative recoveries of 100,000 bbl per well have been achieved at economic production rates during their, typically, 5 year economic life. The recovery is limited by the adverse mobility ratio of heavy oil and water which leads to eventual watering out of the production when water from the aquifer lower in the reservoir breaks through by coning or cresting and the handling cost of water make the operation uneconomic. Although at that point only about 5% of the original oil in place (OOIP) had been recovered, the wells are usually abandoned.

The companies producing heavy oil in the Lloydminster area in the above manner (ie. without thermal stimulation and using horizontal or vertical wells) were initially concentrating their efforts on sand exclusion through the use of gravel packing and screens, only to shut off economic production rates. As the physical mechanisms became better understood, it became apparent that steps should be taken to encourage sand production through aggressive perforation, rather than exclude it. Primary recovery of sand laden heavy crude became known as 'cold production' because heat, such as steam, is not introduced into the reservoir. Technologies were developed to cope with large initial sand cuts, keeping sand production stable and even restoring it after a blockage occured, usually in the horizontal liner section. Cold production became an economic mainstay of heavy oil production strategies for many companies because cheap, small diameter vertical or inclined wells with sand production can often sustain rates 30–90 bbl/d of oil for many years, while horizontal wells with 1000 m slotted liner completions produce at prolific initial oil rates of up to 450 bbl/d, more than enough to pay for the cost of the well and its operation. Sand production increases the rate of heavy oil production by an order of magnitude and raises recoveries from about 5% to about 12% OOIP by creating a large diameter well effect. The ideal reservoir comprises unconsolidated sand 5–15 m thick saturated with heavy oil with gas in solution and it has no free water or gas zones. Wells are generally operated at atmospheric back pressures at hole bottom thus maintaining a maximum drawdown.

The economic primary production of heavy oil is made possible by the co-production of formation sand which is dispersed in reservoir fluids and transported to the surface by artificial lift using a pump that can cope with high sand cuts without a premature wear or breakdown, such as a progressive-cavity pump with low-nitrile, flexible elastomer stator. These rotary devices have a positive displacement, are non-pulsating and are renowned for their reliability in pumping viscous sand-cut crudes.

Sand co-production is a process of continuous liquefaction of sand at a front far from the borehole and it is encouraged through wide, slotted horizontal well liners. Although the cold production mechanism is not fully understood, there are currently two accepted theories explaining the phenomenon: (1) The sand co-production creates irregular circular high permeability channels of unknown geometry or 'wormholes' in the reservoir, thereby increasing both the effective permeability and wellbore radius and (2) the bottom hole pressure reduction gives rise to a viscous 'foamy oil' with gas as a finely dispersed bubble phase in the oil. The foamy zone starts growing around the wellbore causing liquefaction of unconsolidated or poorly consolidated sandstone. The formation of wormholes can result in the removal of 1000 $m^3$ of sand out of the reservoir per well over 5–10 years of stable sand production. The increased rate and recovery of heavy oil by Cold Production is a major improvement over the original concept of a straight bottom water drive, although almost 90% of the OOIP is left behind in the unswept regions of the reservoir at the end of the cold flow economic cycle. This opens up a huge window of opportunity for a process that results in a substantial additional recovery of heavy oil.

The increased drainage radius of a well resulting from a network of high permeability channels and voids left behind in the formation after the implementation of cold production has altered the properties of virgin reservoirs and creates a large area for mass transfer of solvent vapour by diffusion. The existence of these channels also means that inter-well communication is rapidly established at exceptionally low pressures if fluids are injected. These attractive characteristics can be utilized for the application of Vapex, a relatively slow, non-thermal vapour extraction method, to recover a major portion of the hydrocarbons remaining in the reservoirs. These watered-out reservoirs thus become a potential prime source of wealth for many Canadian oil companies.

Another way in which the vast interfacial area for mass trasfer, that results in high production rates in Vapex, can be established is by injecting the solvent vapour into a high permeability aquifer at the base of a virgin reservoir and allowing it to spread as a blanket of solvent vapour between the horizontal injector and horizontal producer, forming a planar well. The high permeability of bottom water serves as a means for providing the initial injectivity. The buoyancy of the vapour results in the formation of rising solvent chambers which increase extensively the already large interfacial contact area. The feeding of these finger-like convection cells occurs vertically as a result of gravity difference between lighter solvent vapour and heavier mobilized oil. The mobilized oil solution is heavier than the solvent vapour and it drains under gravity. The mobile water layer underrides the lighter diluted oil and assists in moving it towards the production well.

SUMMARY OF THE INVENTION

In previous publications and U.S. and Canadian patents (e.g. U.S. Pat. No. 5,407,009) an approach for the recovery of heavy oils was proposed that involves the use of vapourized light hydrocarbon solvents such as ethane, propane or butane. This approach came to be known as 'Vapex'(e.g. References 2–7 of attached REFERENCES). In the patent, a use is made of the high permeability of an underlying layer of high water saturation (a passive aquifer) to spread solvent vapour underneath the hydrocarbon deposit. A solvent chamber is formed in which gravity causes the oil diluted by the solvent to drain to the base of the reservoir with its initial pore volume becoming filled by the solvent vapour. In practice, this process is effective only if appropriate reservoir conditions are met. In particular, it is necessary to have a large area available for mass transfer since diffusive mixing is slow. Even more important, this original concept requires that the reservoir pressure be close to the vapour pressure of the injected solvent since light hydrocarbon vapours only have a high solubility in oil when they are close to their dew point. This restriction seriously limits the applicability of the process to all but a few reservoirs that do not have active aquifers or gas zones and in which the pressure can be controlled appropriately, i.e., maintained at about 500 psig (3.5 MPa) for ethane, 100 psig (800 kPa) for propane and 20 psig (190 kPa) for butane. If the reservoir pressure is higher than the solvent dew point pressure, the solvent vapour condenses and becomes ineffective; if it is lower, the vapour is undersaturated and ineffective. (However, a lower reservoir pressure is rarely a problem. The pressure can usually be raised (as with bitumen reservoirs) or a solvent with lower dew point pressure is used (e.g. butane instead of propane). The reservoir pressure of most common heavy oil deposits is 2–6 higher than propane dew point pressure and in some cases up to 13 times. Since propane appears to be the best all-around Vapex solvent, increasing its dew point pressure to match a variety of deep reservoirs seems highly desirable. By contrast, the inventor is now proposing a process (RASD-VAPEX) in which this restriction placed on the reservoir depth and pressure no longer exists.

A hydrocarbon extraction is described in which partial pressure of the solvent vapour is adjusted to, and maintained at, the vapour dew point under the conditions of pressure and temperature occurring in the reservoir. The partial pressure of the solvent vapour, and therefore its dew point, is tailor-made on the surface to match downhole conditions at a given reservoir depth by mixing the solvent vapour with methane gas often present naturally in the reservoir.

This new concept makes the RASD-Vapex extraction amenable to the majority of reservoirs, particularly to those providing a potential means for large mass transfer, such as reservoirs underlain by an active aquifer or to those that have been partially exploited by cold production. Previously abandoned watered-out 'worthless' reservoirs have now become a potential source of massive wealth because most of the ≈90% OOIP left behind after cold production can now be economically recovered.

Active aquifers underlying oil zones or sand co-production during a cold flow have made the reservoirs more valuable because of the opportunity they offer for spreading a hydrocarbon vapour solvent directly underneath or within the oil formation, increasing the vapour-oil contact extensively. Furthermore, as the water of an active aquifer perculates through the sand underneath the oil deposit, it promotes mixing and assists in spreading the solvent vapour. By positioning the horizontal production well at the bottom of, but within, the oil deposit, the water production is eliminated or kept to a minimum. Switching the wells in a manner described in the Preferred Embodiments makes it practical to obtain the required initial injectivity of the solvent vapour.

As no direct heat is introduced into the reservoir, the extraction is non-thermal and heat losses to overburden and under burden are essentially zero. This makes the process particularly attractive for low porosity or thin reservoirs in which thermal methods are uneconomic. The solvent, or a mixture of solvents, is continuously circulated through the reservoir as saturated vapour. If a single solvent is used, propane appears to be the right choice on account of its 15% higher diffusivity and its approximately four times higher vapour pressure at common reservoir temperatures than butane. Furthermore, unlike ethane, it does not form two liquid phases with oil[8]. As a further economic benefit, in situ deasphalting and demetallizing takes place and the resulting oil is lighter and contains smaller amounts of heavy metals[6]. The initial reservoir pressure is maintained throughout the extraction, preventing the inflow of bottom water from the underlying aquifer and the resulting watering out of the production. If required, the reservoir pressure may also be raised to push and recede the aquifer deeper into the formation, controlling water production.

As it mobilizes the oil by dissolving in the hydrocarbon deposit, the saturated vapour undergoes one phase transition. In consequence, the oil surface in the vicinity of the condensed vapour locally warms up 3–6° C. by the release of latent heat of vapourization of the solvent[3]. This in turn promotes further mass transfer near the oil-solvent interface and lowers the viscosity of the mobilized oil, making its drainage faster. The reservoir becomes warmer. An incipient vapour chamber is formed in which fingers of lighter solvent vapour rise at a constant rate and countercurrently to the draining heavier oil solution[5]. A downhole pump, such as a progressive cavity pump, or the tail gas lift, transport the dilute oil collected in the slotted horizontal section of the production well to the stripper in the surface facilities, where the solvent is boiled off and recycled.

The partially depleted reservoir is at its natural pressure ($P_R$) and temperature ($T_R$) and in communication with a high permeability zone (cold production holes, fracture or an underlying aquifer). At least one pair of horizontal wells (ie. an injection and a production well) has been drilled along the oil-water contact, following the reservoir irregularities. The injection well is drilled at the top of the high permeability zone and the production well at the bottom of the oil formation to limit water production. The wells are placed laterally a certain distance apart and close to the oil-water contact area. The reservoir usually contains sweet natural gas whose dry composition is typically almost pure methane with traces of nitrogen, carbon dioxide, ethane, propane and butane.

MECHANISM

During the startup, an initial communication path between the injector and the producer is established along the whole length of the wells. This is accomplished by forcing into the high permeability zone pressurized solvent-free natural gas that spreads quickly through the path of least resistance, creating a continuous blanket of gas between the horizontal injection and production wells. Following that, natural gas saturated with a vapourized hydrocarbon solvent, typically propane, or, if conditions require, in a mixture with other suitable solvent vapours (eg. butane, ethane or other), passes from the injection well underneath the hydrocarbon deposit to the production well, establishing a planar well[4], ie. an area with large vapour-oil contact. The formation of a planar well using horizontal injector and producer results in production rates comparable to or higher than those obtained in Steam-Assisted Gravity Drainage. Rates of the order of 2,176 bbl/d from heavy oil or bitumen reservoirs with a 1 Darcy vertical permeability have been predicted when 30 acres are drained[4].

The partially solvent-depleted tail gas then rises via the producer annulus to the surface facilities where it is re-saturated with the solvent(s) and re-injected into the reservoir as an injection gas. The oil, gas and some water enter the production well through a slotted liner. The liquids containing solution gas are forced by a downhole pump through a tubing of the production well to the surface, gasses are produced through an annulus between a casing and the tubing. As an alternative, gas lift provided by the tail gas may be sufficient to scale down or eliminate the downhole pumping equipment. In that case the surface compressor drives the gas circulation and oil transport to the surface.

While in contact with the underbelly of the oil formation, some of the saturated solvent vapour carried by the natural gas dissolves in the oil. This process is a result of diffusion because the partial pressure of the saturated solvent vapour in the natural gas is more than it is in the oil. This difference in partial pressures provides the driving force for diffusion. The solvent diffusive flow therefore occurs from a region of higher to a region of lower partial pressure, ie. into the oil, irrespective of the pressure due to other components of the gas mixture. To maintain the flow, a continuous reservoir circulation of excess solvent as free gas should be maintained. As a result, the oil diluted with the solvent becomes mobile and flows under its own weight towards the slotted liner of the horizontal production well located at the bottom of the reservoir. In the process a virgin oil surface (ie. a surface that does not have any solvent dissolved in it) is exposed and the mechanism of diffusion, dissolution, mobilization and gravity drainage repeats itself naturally until the resulting rising solvent chambers[5] reach the top of the reservoir. The rate of rise of these chambers is constant. The space to formerly occupied by oil is now filled with natural gas containing vapourized propane solvent saturated under reservoir conditions.

The oil may also become in situ deasphalted by the condensed (i.e., dissolved) propane (see Reference 6). Heavier oil fractions of the hydrocarbon mixture (asphaltenes) stay behind deposited on the reservoir matrix, while the lighter and more valuable deasphalted oil is recovered. The heavy asphaltene fractions left behind may constitute about 5–15% by wt. of the original oil. This weight does not have to be transported to the surface, representing energy savings. Deasphalting lowers the viscosity of deasphalted oil by an order of magnitude or more and increases its gravity by about 3–5° API (see Reference 6). It was found that the deposited asphaltenes do not normally plug up the reservoir. However, if asphaltenes are precipitated en masse, such as by an excess amount of liquid propane, the reservoir will plug up, particularly around the production well.

BRIEF DESCRIPTION OF THE DRAWINGS

There will now be described a preferred embodiment of the invention, with reference to the drawings, by way of illustration, in which like numerals denote like elements and in which:

FIG. 10 is a schematic of an exemplary circulation of the solvent for implementing the method of the invention in the Adjusted Dewpoint process, as compared to Simple Vapex.

Figure 1:
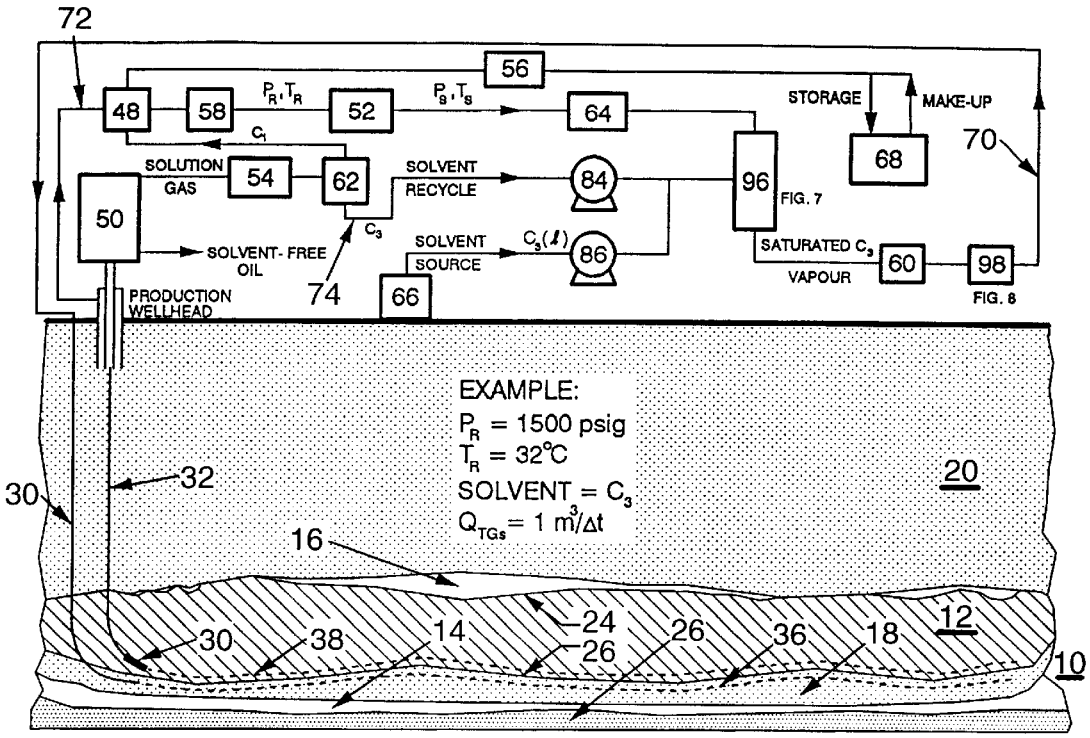
FIG. 1 is an overall schematic diagram of the apparatus for implementing the method of the invention with a section through a petroleum reservoir showing the injection of a hydrocarbon solvent vapour into an aquifer underlying the hydrocarbon deposit and the recovery of hydrocarbons from a point low in the hydrocarbon deposit; simplified surface facilities, which are detailed in FIG. 6, are also illustrated.

While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

A petroleum reservoir 10 lying in a permeable formation or formations is illustrated in FIG. 1 including a hydrocarbon deposit 12 (ie. a deposit containing high viscosity hydrocarbons such as heavy crude oil or bitumen), a reservoir gas cap 16 and a permeable layer containing an aquifer 18. The deposit 12 is underlain by the aquifer 18 which in turn is bounded from below by a lower boundary 14 below which is the underburden 22. Overburden 20 above the petroleum reservoir 10 is also illustrated along with the gas-oil contact 24 and oil-water contact 26. The reservoir 10 is exemplary, not all reservoirs will have this structure. As for example there may be no gas cap 16 and overburden above the hydrocarbon deposit, or the permeability of the hydrocarbon deposit 12 may be altered by a multitude of irregular channels 28 left behind after cold flow production, as in FIG. 5*a* and *b*. Nevertheless, the economic operation of the invention requires the presence of an aquifer 18, or of high permeability channels 28, or a horizontal fracture. The aquifer 18 is preferably an active aquifer with prolific water production, ie. with high horizontal permeability, so that injection of hydrocarbon vapour employing a horizontal injection well 30 into the aquifer results in mobility of the hydrocarbon solvent an appreciable distance laterally in the aquifer under the reservoir 12, but at least to the horizontal production well 32, which contains a pump 40. The gas cap, aquifer and the hydrocarbon deposit are in an equilibrium at a pressure $P_R$ and temperature $T_R$. There are surface facilities on top of the reservoir that process tail gas from line 72 into an injection gas that is passed via line 70 into the reservoir. Detailed description of surface facilities is given in FIG. 6.

Figure 3:
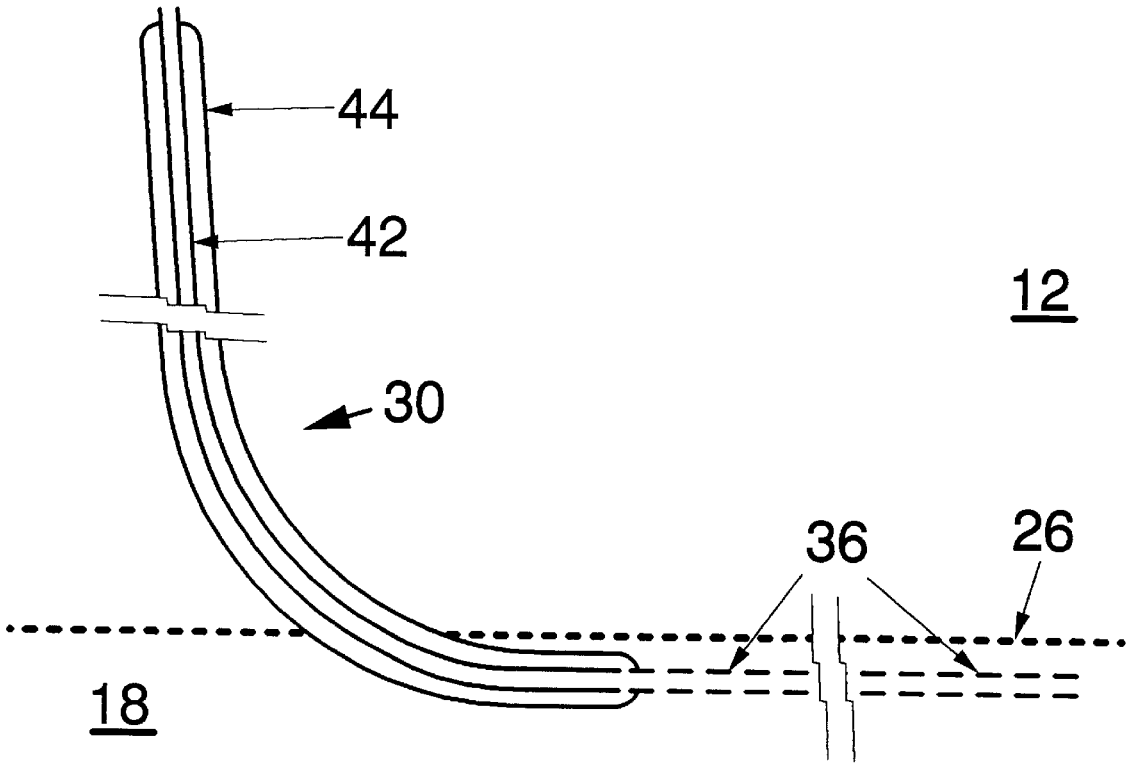
FIG. 3 is a schematic showing an exemplary horizontal injection well for use in implementing the method of the invention.

As illustrated in FIGS. 1 and 3 particularly, a horizontal injection well 30 with tubing 42 and casing 44 is drilled into the reservoir 10 just below the oil-water contact 26 using known techniques, preferably with a significant length of well 30 lying in the permeable layer 18. Significant in this context means 10 m or more, preferably over 100 m, for example 1,000 m. That part of the well 30 lying in the permeable layer 18 is open to the hydrocarbon deposit 12 such as by perforation of the well tubing as shown at 36. The length of the horizontal portion of well 30 must approximately match the length of the horizontal portion of wells 32 in the array of alternating wells.

Figure 2A:
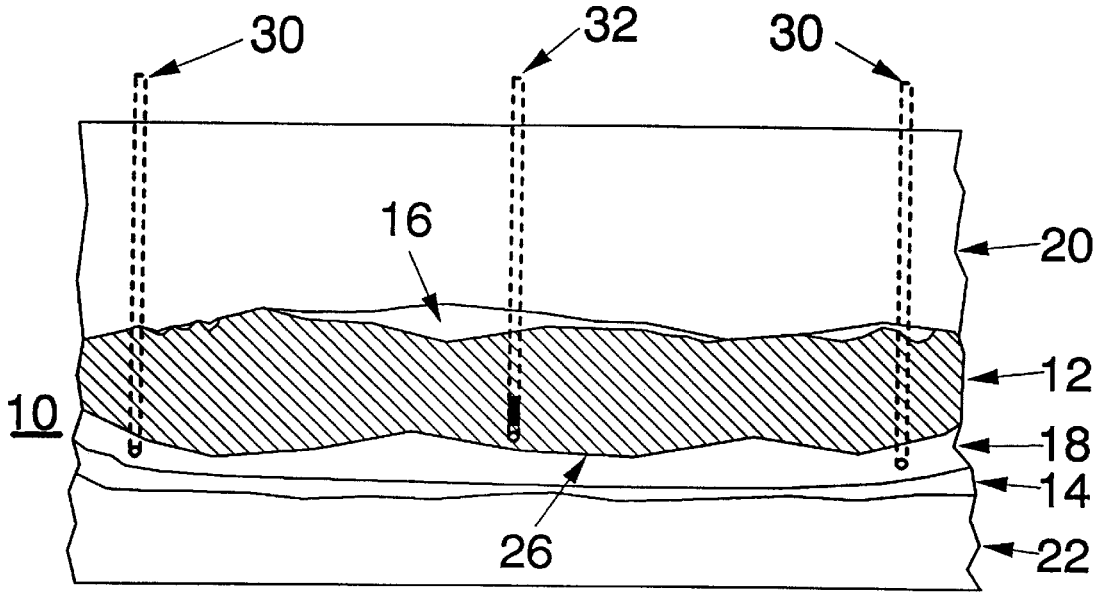
FIG. 2*a* is a schematic section through a reservoir showing an array of parallel horizontal injection wells in an aquifer below a hydrocarbon deposit and horizontal production wells in an oil bearing zone, with alternating wells used for vapour injection and hydrocarbon recovery.
Figure 4:
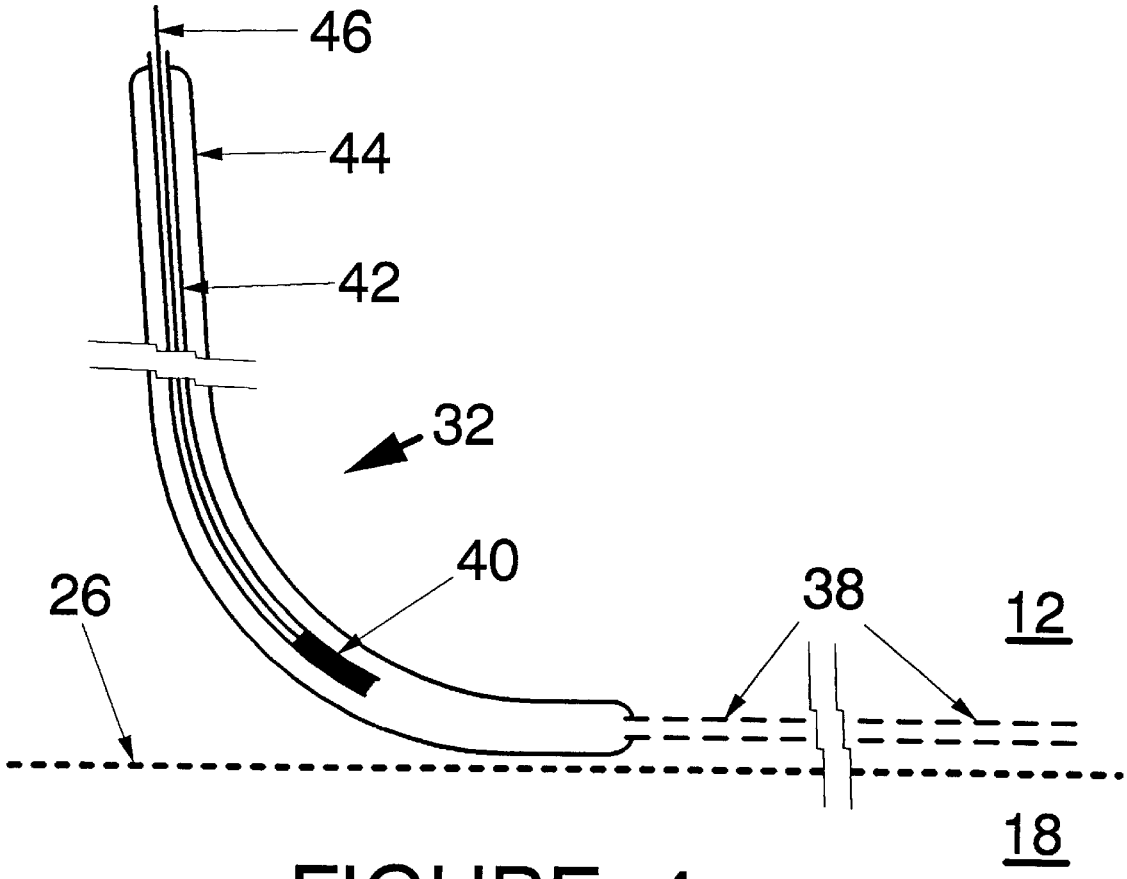
FIG. 4 is a schematic showing an exemplary horizontal production well for use in implementing the method of the invention.

A horizontal production well 32, with tubing 42 and casing 44 is also drilled using conventional techniques into the reservoir 10, and extends laterally into the hydrocarbon deposit 12 as illustrated particularly in FIGS. 1 and 4. A significant length of the production well 32 lying horizontally in the hydrocarbon deposit 12 is open, as for example by using a slotted liner portion 38 of the well to the deposit just above the oil-water contact 26 and above the aquifer 18. The pump 40 is located in the inclined portion of the well 32. The pump 40 is preferably a positive cavity pump suitable for handling low gravity sand laden crude. The rotor of the pump is attached to a sucker rod string 46 which is suspended and rotated by the surface drive. After the initial breakthrough and start of the oil drainage, the pump transports production oil from the casing 44 up the tubing 42 to the surface where it is produced in a conventional manner. As illustrated in FIG. 2*a*, the injection wells 30 and production wells 32 are preferably spaced approximately parallel to each other and alternate with each other. Injection wells 30 are drilled at the top of the aquifer 18 while the production wells 32 are drilled at the bottom of the hydrocarbon deposit 12.

Figure 2B:
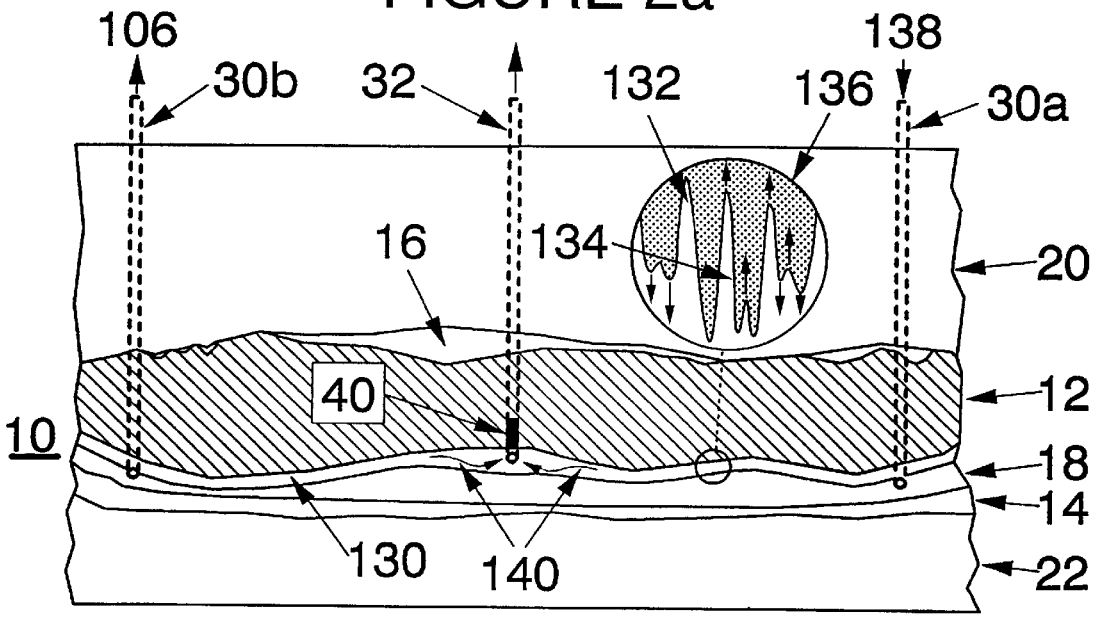
FIG. 2*b* is a schematic section through a reservoir showing the reversed start-up operation of one of the injection wells.

With reference to FIG. 2*b*, the initial communication path between injectors and producers and the start of oil production from well 32 is accomplished as follows: Solvent-free natural gas 138 is injected at a pressure substantially above the reservoir pressure into the permeable layer 18 using a horizontal to injection well 30*a*. The gas injection into the aquifer is carried out at a sufficiently high rate to prevent the gas from rising into the reservoir vertically near the injection well and spreading along the top of the hydrocarbon deposit. While this would produce hydrocarbon from the reservoir, production rates are lower since there is less interfacial area available for mass transfer.

The function of the horizontal injection well 30*b* is temporarily reversed by using it to lower the bottom hole pressure and produce the water displaced by the injection of solvent-free natural gas 138. After gas breakthrough at well 30*b* the well is throttled and the original reservoir pressure is restored; the injected natural gas is then enriched with solvent vapour to constitute the injection gas 108 and a steady stream of tail gas 106 is maintained from well 30*b* to keep the communication path open. The injection gas thus originates from well 30*a*, passes through the aquifer 18, spreads across the area below the hydrocarbon deposit 12 between wells 30*a* and 30*b*, and underneath the well 32, and leaches out the oil from deposit 12.

At the same time, production well 32 equipped with a progressive cavity pump 40, or a similar pump, produces oil in a primary production mode, until gas breaks through into well 32, causing a declivity in the gas flow from well 30*b*. At this time the flow of well 30*b* is reversed and its normal operational function as a regular gas injection well 30 is restored, the wells being operated as in FIG. 2*a*. At this point a blanket of solvent vapour 130 has spread between the injection wells 30 underneath hydrocarbon deposit 12 and an incipient solvent chamber 136 is formed, as illustrated in the inset of FIG. 2*b*. The blanket of solvent vapour 130 to eliminates direct oil-water contact in the reservoir and if required, its vertical thickness can be increased by raising the reservoir pressure to lower the water level in the aquifer between the injection wells. The propane dew point in the injection gas is then readjusted accordingly.

This strategy permits production of oil from hydrocarbon deposit 12, using a production well 32 located in the deposit 12, without producing copious amounts of water from active aquifer 18. The result is that saturated hydrocarbon vapour spreads across the area between wells 30, rises as a continuous blanket because of buoyancy, forming rising solvent vapour fingers 132 across the underbelly of the hydrocarbon deposit 12 and penetrates vertically the overlying hydrocarbon deposit 12, where it dilutes, demetallizes and deasphalts oil which drains countercurrently 134 to rising solvent fingers 132, accumulates on top of the aquifer 18 and flows towards the production well 32 as indicated by arrows 140. The interface between oil and vapour rises steadily until the supply of oil has been exhausted, near the top of the hydrocarbon deposit 12. The pore space originally filled with oil is filled with injection gas, preventing the aquifer from expanding into the growing solvent chamber 136, until the project is at the end of its economic cycle.

Figure 5A:
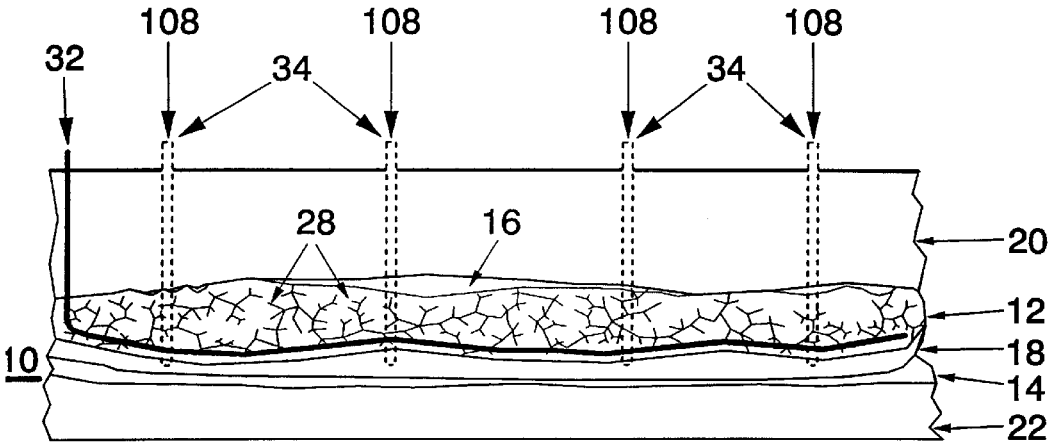
FIG. 5*a* is a schematic section through an exemplary reservoir showing a horizontal production well drilled around an array of vertical injection wells in a reservoir produced by cold flow for implementing the method of the invention.
Figure 5B:
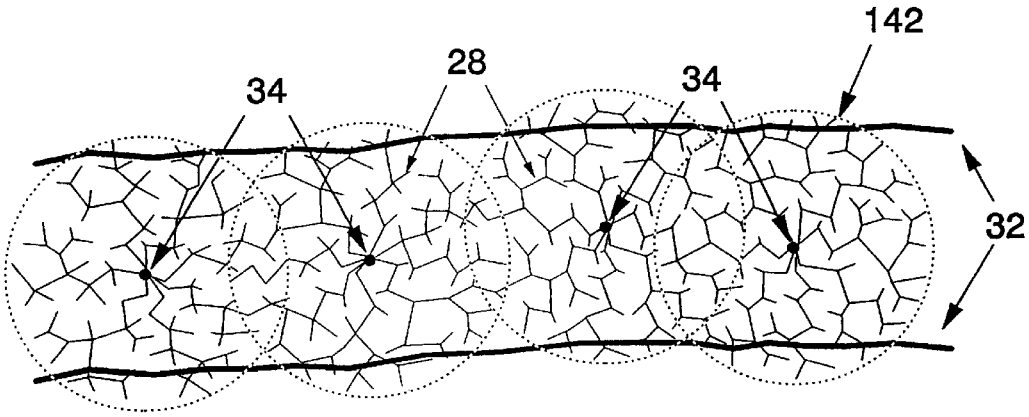
FIG. 5*b* is a top view of an exemplary reservoir showing an array of vertical injection wells in a reservoir produced by cold flow in relation to the horizontal production well.

FIG. 5*a* shows a section through a petroleum reservoir 10 produced by cold flow employing vertical or inclined wells 34 drilled into the hydrocarbon deposit 12, containing viscous heavy crude. A permeable layer forming an aquifer 18 underlies the deposit and a gas cap 16 overlies it. The deposit 12 is bounded from below by a lower boundary 14 which rests on top of the underburden 22 and from above by overburden 20. The reservoir 10 is exemplary, other reservoirs may have different structures, for example they may not have the aquifer 18 or gas cap 16. The partially produced hydrocarbon deposit 12 is perforated by a multitude of irregular highly permeable channels 28 left behind after cold flow production. These channels through the deposit are required for the operation of the invention. A horizontal production well 32 with tubing 42, casing 44, slotted liner 38 and progressive cavity pump 40, as illustrated in FIG. 4, is drilled near the bottom of the deposit 12, making a contact with many of the worm holes 28. A significant length of the horizontal portion of well 32 is exposed and open to the deposit 12 such as through a slotted liner 38. The well 32 is drilled around the existing vertical or inclined wells 34 but within the area perforated by the worm holes 142. This is illustrated in FIG. 5*b* as circles 142 indicating the outer limit of worm hole growth. Injection gas 108 is introduced into the perforated hydrocarbon deposit 12 using existing wells 34 and the mobilized oil drains through the multiple channels into the production well 32 and is pumped to the surface in a conventional manner.

Figure 6:
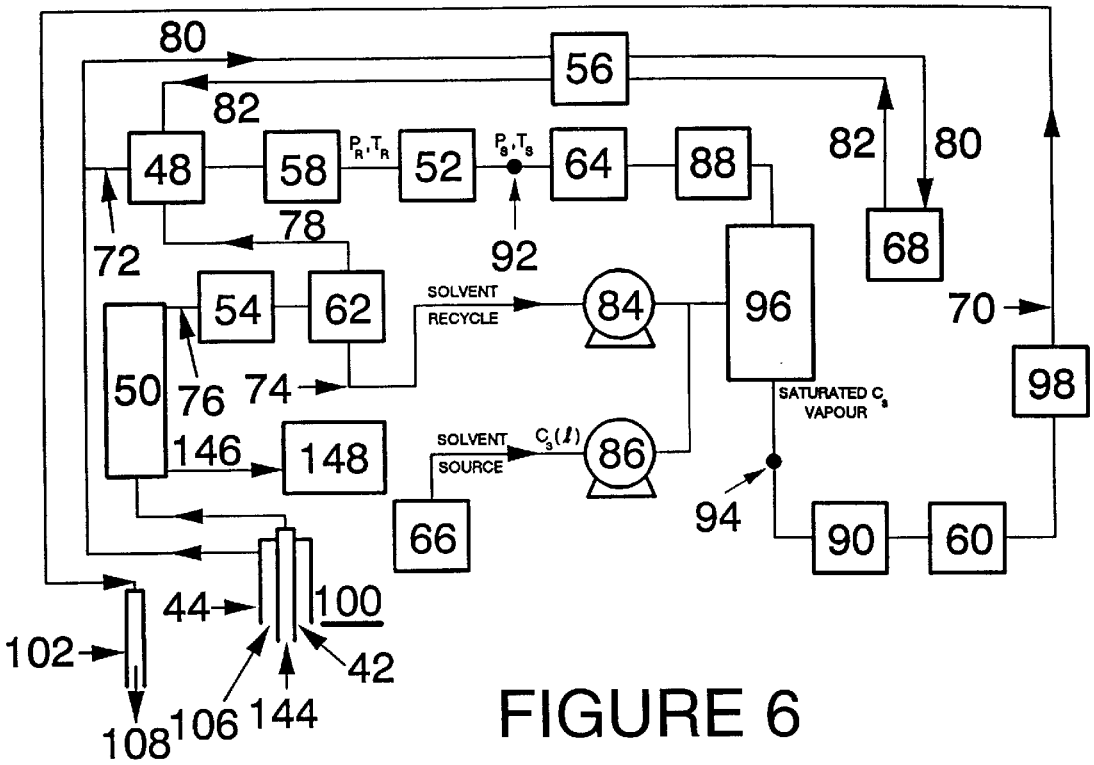
FIG. 6 is a schematic showing the surface facility for implementing the method of the invention including the injection and production wellheads.

The surface facility for treating and processing the recovered fluids is illustrated schematically in FIGS. 1 and 6 particularly. The facility consists in essence of a solvent stripper 50, separator 62 and a solvent injector 96. Mobilized production oil 144 (with solution gas and some water) is forced by a down hole pump 40 of FIG. 4 through tubing 42 of the production well 100 to the solvent stripper 50. Free tail gas 106 produced along with the oil passes through the annulus between the tubing 42 and casing 44 to a dryer 48. However, if the tail gas 106 is stored temporarily, it is transferred by compressor 56 directly to a start-up or make-up storage facility 68, as indicated by arrow 80.

The oil and dissolved gases have vastly different boiling points so that the separation in stripper 50 is simple. Heat is applied to the oil in the stripper to lower the oil viscosity and to facilitate the release of solution gases (ie. the dissolved solvent and natural gas). Solvent-free oil is produced along line 146 leading from the stripper 50 to a stock tank 148, while solvent vapour with natural gas are produced along line 76. The solubility of natural gas in oil is much less than that of the propane solvent (or other hydrocarbon solvents) so that the liberated solution gas 76 consists mostly of propane. Compressor 54 increases the pressure and condenses the propane solvent out of the mixture, while methane remains as gas. The solvent is then separated as a liquid phase from the natural gas in separator 62 and the liquified solvent ($C_3$) is recycled by a metering pump 84. Depending on its quantity, the natural gas from the separator 62 may be flared, used as a fuel or, as indicated in FIG. 6 by arrow 78, combined with the tail gas from the wellhead annulus 106 and storage facility 68 in the dryer 48 to remove water from the gases. Tail gas 106 comprises natural gas with undersaturated solvent vapour, so that when combined in the dryer 48 with more natural gas 78, the vapour becomes more undersaturated.

During the start-up, a part of the tail gas 106 from wellhead annulus is transported by compressor 56, along line 80, into a storage facility 68 for a later retrieval along line 82, as is required by volume balance during mixing.

The tail gas from dryer 48 is transported by an in-line compressor 52 to the solvent injector 96. In the process the pressure and temperature of the tail gas will rise from about reservoir conditions $P_R$ and $T_R$ to slightly higher surface values $P_S$ and $T_S$, as indicated in FIG. 6. This pressure differential drives the gas circulation and its magnitude depends on the well spacing and reservoir depth. It partially dissipates along the way to the oil formation. The composition of the tail gas mixture is determined by a gas chromatograph 58, its flow by a flowmeter 64 and its temperature and pressure by thermocouple 92 and pressure transducer 88.

The solvent injector 96 operates at slightly above reservoir pressure ($P_S > P_R$). The liquid solvent injected into 96 is either a recycled solvent delivered by a metering pump 84 or a make-up solvent from source 66 delivered by a metering pump 86. In the injector 96 the solvent is vaporized, atomized and mixed with the dry tail gas 106 from the well head annulus. An equivalent amount of heat supplied in the injector to vapourize the liquid solvent will be released in the reservoir by the solvent condensing into the oil interface. As the reservoir is being gradually depleted, the volume of oil produced from the pore space is replaced with an equivalent volume of propane saturated natural gas to maintain the volumetric balance, the reservoir pressure and to prevent an invasion of water from the aquifer; there is therefore a need for an equivalent make-up volume (at $P_R$ and $T_R$) of solvent and natural gas to be injected into the reservoir. The make-up solvent is delivered by a calibrated metering pump 86 into the solvent injector 96. A make up natural gas 82 from make-up storage facility 68 is transported by compressor 56 to be dried in a dryer 48, mixed with the tail gas 106 before being enriched with solvent in the injector 96. The propane solvent (as well as the natural gas) is recovered from the reservoir during a blow-down at the conclusion of the project, whose life is usually 5–10 years. During the blow-down the depleted reservoir 10 is flooded by the aquifer 18 and becomes a part of it.

As an alternative, the dispersal of liquid propane into a fine mist (atomization) in the solvent injector 96 can also be effected by a hot plate, vibrating transducers, microwave radiation of a certain frequency or by combination of the above. The required molar composition of the natural gas—solvent mixture is determined by a mass balance using data obtained from gas chromatograph 58, thermocouple 92, pressure transducer 88 and an in-line flow meter 64. This meter can be an orifice meter, a ventury meter, nozzle or a similar device. The final composition, temperature and pressure of the injection gas in line 70 is verified by a gas chromatograph 60, thermocouple 94 and pressure transducer 90. A dew point check device 98, detailed in FIG. 8, controls the final solvent vapour saturation of injection gas in line 70. If the device indicates a presence of liquid solvent in the gas stream, a feed back loop, illustrated in FIG. 9 cuts down the amount of liquid solvent injected by the metering pumps 84 and 86. The result is that natural gas containing saturated solvent vapour at reservoir conditions is continuously circulated underneath the oil deposit 12, allowing the establishment and growth of a solvent vapour chamber 136, causing leaching of heavy oil or bitumen by a natural convection process and resulting in a recovery and pumping of the diluted oil to the surface stock tank 148.

It is important to circulate the injection gas 108 speedily through or underneath the hydrocarbon deposit 12 by producing free gas so that the solvent concentration in the tail gas 106 is maintained at, or preferably above, about a half of the initial solvent concentration in the injection gas. This will maintain a maximum change in partial pressure of propane solvent over some short distance near the oil-gas interface in the solvent chamber 136, promoting solvent vapour diffusion into a freshly exposed oil surface and minimizing the need for $C_3$ vapour diffusion through natural gas. This gas-through-gas diffusion is slow at high pressures, such as $P_R$, and it is essential to limit it to very short distances. Maintaining the propane concentration gradient at the oil-gas interface high by making the solvent rich gas abundant through fast circulation of injection gas 108 will lead to shorter gas-in-gas diffusion distances and this in turn will promote higher rates of oil recovery. The limiting factor might be the ability of the wells to handle a stream of high pressure gas.

Figure 7:
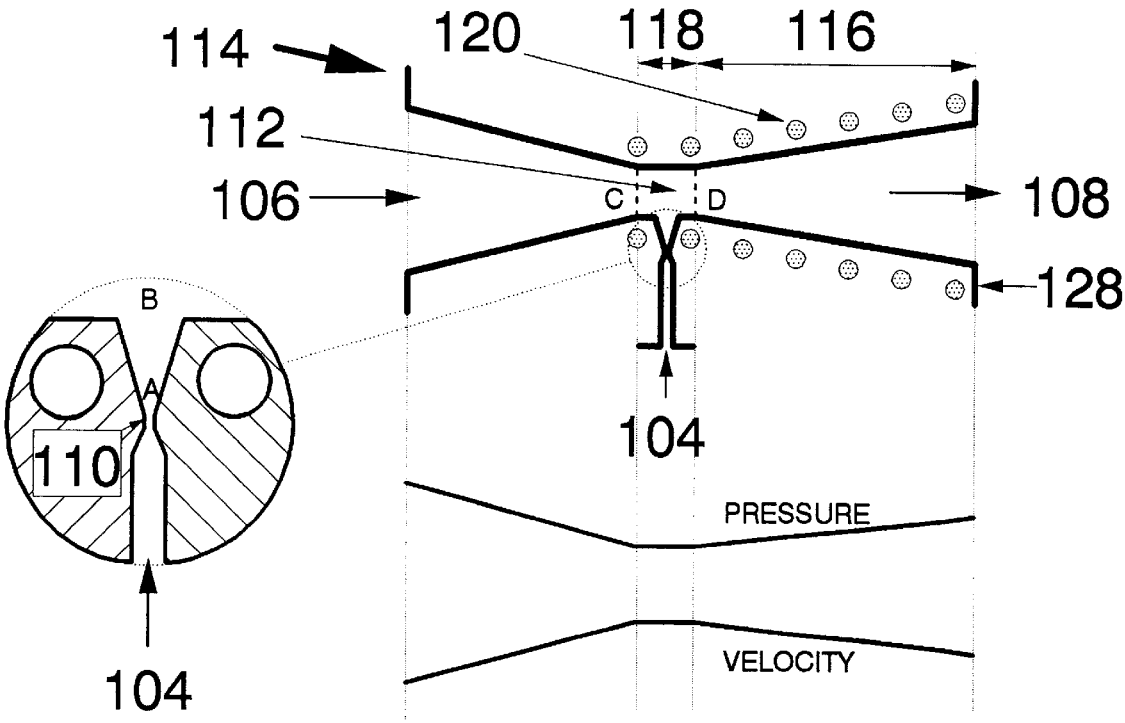
FIG. 7 is a schematic showing the solvent injector, a part of the apparatus for the implementing of the method of the invention.

The solvent injector 96, a device for converting tail gas 106 into injection gas 108, is illustrated schematically in FIG. 7. It has no moving parts and will handle large volumes of tail gas 106 from the dryer 48. It is connected between the injection gas line 70 and tail gas line 72 using flanges 128. Liquid propane 104 is injected under high pressure from a metering pump 84 or 86 (in FIG. 6) into a narrow nozzle 110 where it expands into a region of lower pressure along A-B, as illustrated in the inset of FIG. 7. The expansion within the region A-B of nozzle 110 causes vapourization of the liquid propane which is then swept into a throat 112 of a venturi 114 where it mixes with the tail gas 106 along C-D. Expansion cooling of the propane could lead to icing conditions inside the nozzle 110, mixing zone 118 and diffuser 116 resulting in an occlusion of the passages. To counteract this, the tail gas 106 is dried in a dryer 48 (FIG. 6) and the nozzle 110, to mixing zone 118, and the diffuser portion 116 of the venturi 114 are maintained at elevated temperature by a heater coil 120.

The mixing zone 118 between C and D is located in the throat of the heated venturi 112 where the low pressure and heat assist in flashing the liquid 104 and mixing the resulting vapour with the tail gas 106. The hot diffuser walls 116 atomize the propane vapour, allowing for complete mixing. The expansion slows down the injection gas mixture 108, bringing up the gas pressure to slightly below the venturi inlet pressure, as illustrated with the velocity and pressure profiles below the ventury 114 in FIG. 7.

Figure 8:
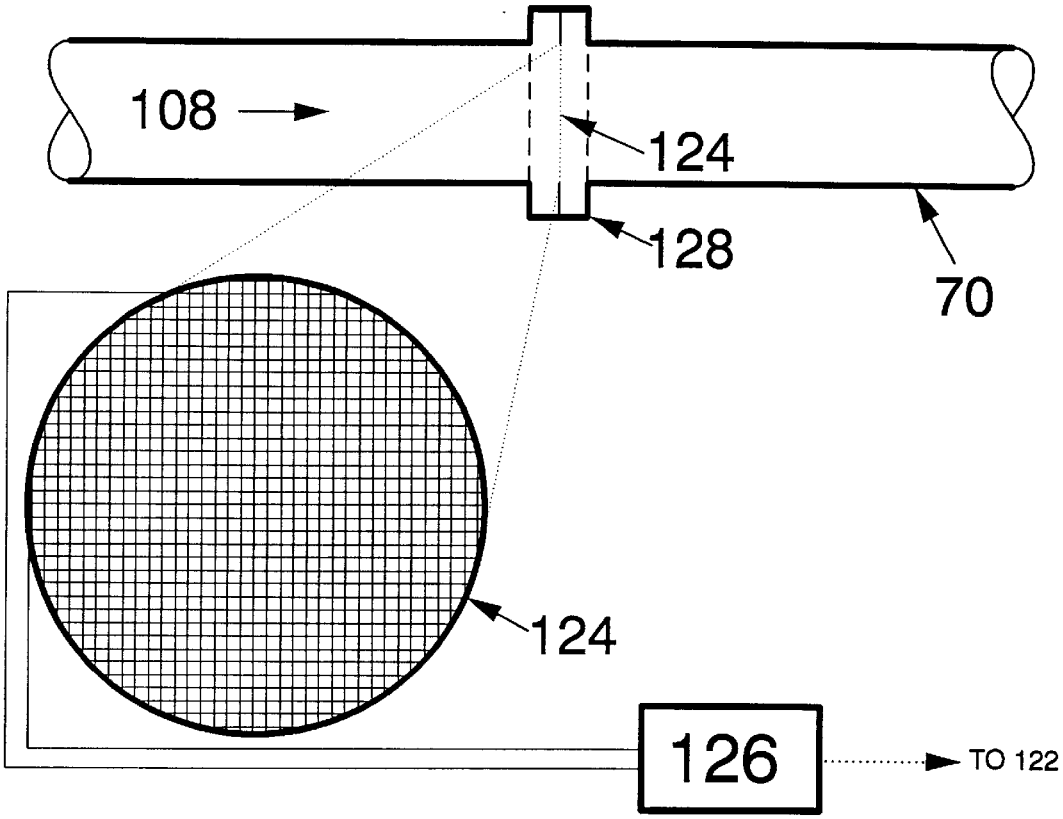
FIG. 8 is a schematic showing the dew point check device, a part of the apparatus for the implementing of the method of the invention.

FIG. 8 is a schematic of a dew point check apparatus 98 fitted in the flange 128 of the injection gas line 70, in FIG. 6. To ensure that the injection gas 108 contains solvent vapour at its dew point but without condensed droplets of liquid solvent entrained in it, the fluid in line 70 passes through a screen of resistor wires 124 placed perpendicularly to the flow of the injection gas 108. The resistor wires 124 are balanced in a Wheatstone bridge 126 so that there is no current flowing through the electric circuit at a given flow rate of dry injection gas 108 prior to the startup. The bridge 126 is very sensitive to changes in the electric resistance of the resistor wires 124, whose resistance varies with temperature. If the wires get cooled by the evaporation of liquid droplets of solvent entrapped on the resistor wire mesh, the Wheatstone bridge circuit 126 is thrown out of balance and a current registers in a control module 122 in FIG. 9. The module then makes adjustments to the solvent metering pumps 84 and 86 to eliminate the excess solvent.

Figure 9:
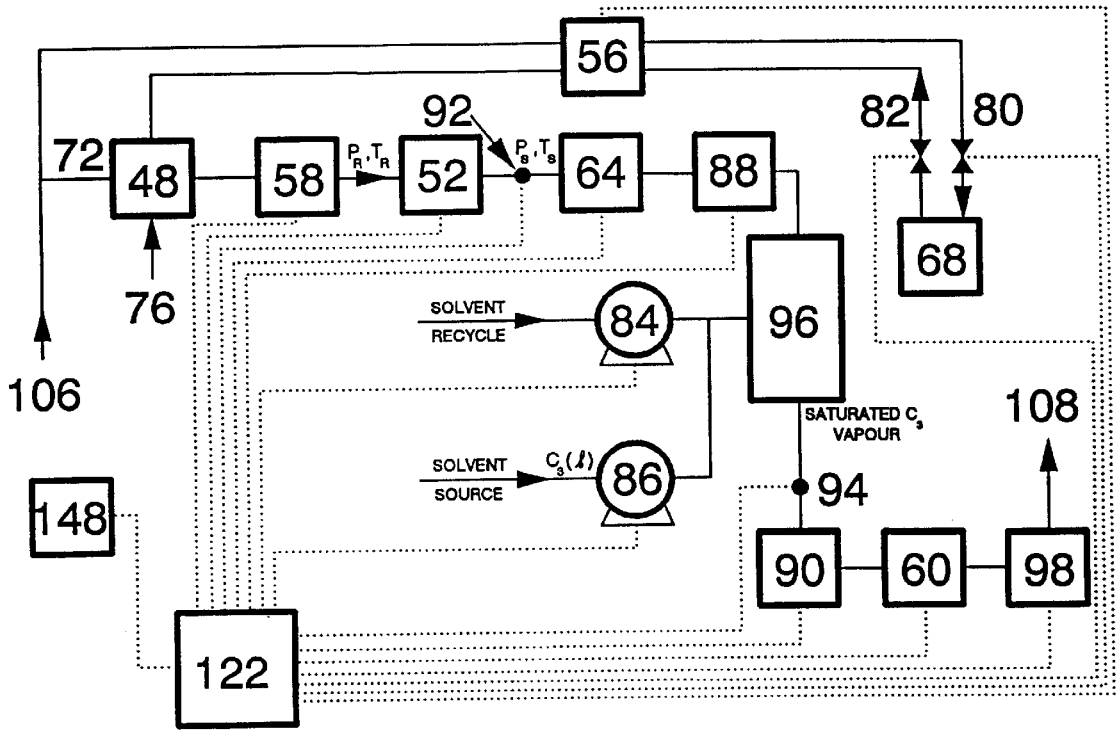
FIG. 9 is a schematic of the control system for the apparatus for implementing the method of the invention.

FIG. 9 is a schematic of the control system. Control module 122 collects data from gas chromatographs 58 and 60, flow meter 64, pressure transducers 88 and 90, thermocouples 92 and 94, stock tank 148 and the dew point check device 98. The module is programmed to adjust the amount and composition of the injection gas 108 for reservoir conditions of temperature and pressure by switching storage 80 and make-up 82 lines, operating metering pumps 84 and 86 and running compressors 52 and 56. For instance, if gas chromatograph 60 and dew point check 98 indicate too rich an injection mixture, the module 122 may slow down the metering pump 84 and increase flow of make-up natural gas using compressor 56.

FIG. 10 is a schematic of the solvent recycle and makeup.

It is assumed that the reservoir is bounded and therefore there is no loss of injection gas to the reservoir outside of the recovery pattern. The volume of fluids withdrawn from the reservoir may contain oil, some water, solution gas and free gas and is measured at reservoir conditions of $T_R$ and $P_R$.

Two conditions with respect to the injection gas must be satisfied:

i. The gas contains saturated solvent vapour (by itself or with other saturated solvents) at $T_R$ and $P_R$. Such an injection gas is said to have a dew-point composition; and ii. Each volume of fluids withdrawn from the reservoir is replaced with an equal volume of injection gas at $T_R$ and $P_R$.

The first condition assures that the maximum possible benefit is derived from the effect of solvent in the reservoir. Vapour is the key word, liquid solvent is detrimental to both the physical process and its economic feasibility.

The second condition assures that the reservoir balance stays unperturbed, preventing aquifer invasion or solvent loss while maintaining solvent saturation established on the surface. This strategy may be temporarily abandoned if for instance circumstances require that water level in the aquifer be lowered to limit water production.

1. Startup Injection

At the beginning there is no oil mobilization and the tail gas flow consists almost entirely of methane. The tail gas is converted into injection gas through the addition of a solvent. In the example (FIG. 1) the startup tail gas volumetric flow rate $Q_{TGs}$ is assumed 1 $m^3/\Delta t$, where $\Delta t$ is a time interval. This interval is a function of reservoir size—the larger the reservoir, the smaller $\Delta t$ becomes. The fluids flow at reservoir conditions, ie. at $T_R$=32° C. and $P_R$=1,500 psig. Assuming $P_{bar}$=12.75 psia, this translates into an absolute reservoir pressure $P_R$=10.43 MPa or 104.30 bar.

a. Injection Gas Dew-Point Composition

Consider a simple binary mixture of propane vapour and methane gas (see Reference 2). The composition of the mixture is tailored on the surface so that a diluted but saturated propane vapour is circulated through the reservoir at the prevailing downhole conditions of temperature and pressure. In this example the vapour pressure of propane at $T_R$=32° C. is $P_V$=1.139 MPa and this value is set equal to the propane partial pressure $\bar{p}_{C3}$ in the $C_1/C_3$ mixture. The partial pressures of propane and methane in the injection gas then become $$\bar{p}_{C3}=1.139 \text{ MPa} \tag{1}$$

$$\bar{p}_{C1}=10.43-1.139=9.291 \text{ MPa} \tag{2}$$

For an ideal gas mixture $$\bar{p}_{pi}=y_i \cdot P \tag{3}$$

where $\bar{P}_i$ is the partial pressure of component i, $y_i$ is the mole fraction of component i in the gas mixture and P is the total pressure (in our case $P=P_R$). Propane concentration in the mixture $T_R$ and $P_R$ will therefore be $$\bar{p}_{C3}/P_R=1.139/10.43=0.1092, \text{ or } 10.92 \text{ mol } \%.$$

The required dew-point composition of the injection gas for the prevailing downhole conditions is given by the molar ratio of methane and propane as:

$$C_1:C_3=89.08 \text{ mol } \%:10.92 \text{ mol } \% \tag{5}$$

More complex mixtures are also possible. For instance the dew-point composition of an injection gas consisting of $C_1$, $C_2$, and $C_3$ for the same downhole conditions is (mol%):

$$C_1:C_2:C_3=42.33:46.75:10.92$$

and similarly $$C_1:C_2:C_3:C_4=39.45:46.75:10.92:2.88$$

However, in view of the added complexity and potential complications (e.g. near-critical temperature for $C_2$ and low partial pressure of $C_4$), there seems to be little or no advantage in including $C_2$ and $C_4$ in the injection gas.) b. Propane Flow Rate Molar volumes of the gases at partial pressures $\bar{p}_i$ and at the mixture temperature $T_R$=32° C. can be predicted to within a few percent from the 2-constant Redlich-Kwong equation. The calculated values are given below (sub s=startup injection). Since the injection gas and tail gas are at a constant temperature $T_R$=32° C., only the value of pressure at which the volume was determined is given at the foot of the vertical bar.

$$V_{C1s}=238.1\ cm^3/molC_1|_{9.291\ MPa} \quad (6)$$

$$V_{C3s}=1,818\ cm^3/molC_3|_{1.139\ MPa} \quad (7)$$

The molar volume of an ideal gas mixture is the sum of molar volumes of individual species multiplied by their mole fraction, each volume evaluated at the mixture temperature but at the partial pressure of the species, ie.

$$V(T_R, P_R)=\Sigma y_i V_i(T_R, \bar{p}_i) \quad (8)$$

so that the molar volume $V_{IG}$ of an ideal binary gas mixture ($y_i$ is a mol fraction of component i, $_{IG}$ stands for injection gas) is $$V_{IG}=y_{C1}\cdot V_{C1s}+y_{C3}\cdot V_{C3s}=[(0.8908\cdot 238.1)+(0.1092\cdot 1,818)]\ cm^3/mol=212.10+198.53 \quad (9)$$

$$V_{IG}=410.63\ cm^3/mol\ mixture|_{10.43\ MPa} \quad (10)$$

Total volume $V_T$ of mixture considered=1 $m^3$ at 10.43 MPa and 32° C.

$$V_T=n\cdot V_{IG}=10^6\ cm^3 \quad (11)$$

The total number of moles in 1 $m^3$ of the mixture at 10.43 MPa is $$n=V_T/V_{IG}=10^6\ cm^3/410.63\ (cm^3/mol\ of\ mixture)=2,435.28\ mol\ of\ mixture \quad (12)$$

Out of this total, 89.08% or 2,169.35 moles is methane and 10.92% or 265.93 moles is propane. The flow of propane within the injection gas is $$\dot{Q}_{C3s}=0.1092\cdot 2,435.28\ mol\ C_3/\Delta t=265.93\ mol\ C_3/\Delta t \quad (13)$$

c. Volume Balance

The initial communication path between the injection and production wells is established with solvent-free natural gas. Following that, the partial pressure (concentration) of solvent vapour in the recovery pattern is raised to the dew point value expeditiously and without altering the reservoir pressure balance by matching the volumetric flow rates of tail gas and injection gas. This objective is accomplished by diverting a volume of the startup tail gas, consisting initially of almost pure methane, elsewhere (SAGD project, stripper, flare or storage for later use as a make-up) and replacing it with an equal volume of propane vapour. (The startup injection is a transient-state process. The solvent concentration in the tail gas gradually increases from zero to some steady-state value. The calculation in Eqs 14–20 refers to the beginning when the tail gas consists almost entirely of methane.) Since the solvent chamber had not yet been established, there is no production of solvent-mobilized oil. All oil produced at this stage is the result of gas displacement.

Partial volumes of methane and propane in 1 $m^3$ of injection gas with dewpoint composition at 10.43 MPa are $$\bar{V}_{C1s}=2,169.35\ mol\cdot 238.1\ cm^3/mol=0.5165\ m^3|_{9.291\ MPa} \quad (14)$$

$$\bar{V}_{C3s}=265.93\ mol\cdot 1818\ cm^3/mol=0.4835\ m^3|_{1.139\ MPa} \quad (15)$$

$$V_{IGs}=\bar{V}_{C1s}+\bar{V}_{C3s}=0.4835m^3+0.5165m^3=1m^3\ mixture|_{10.43\ MPa} \quad (16)$$

However, the same 2,169.35 moles of methane comprising the startup tail gas at 10.43 MPa and 32° C. occupies a smaller volume as a result of higher pressure, ie.

$$V_{C1TG}=2,169.35\ mol\cdot 209.799467\ cm^3/mol=0.4551\ m^3|_{10.43\ MPa} \quad (17)$$

This is the volume of startup tail gas to which propane is added to establish dew-point composition of the injection gas (Eq. 5) while maintaining the reservoir volume balance. In a time interval Δt, 1 $m^3$ of the initial tail gas flow at 10.45 MPa is divided into $$0.4551\ m^3/\Delta t\ \text{to be mixed with } C_3 \text{ to constitute the startup injection gas} \quad (18)$$

$$\text{and } 0.5449\ m^3/\Delta t\ \text{that is diverted elsewhere.} \quad (19)$$

From Eq.(13), the startup injection rate of propane is:

$$265.93\ mol/\Delta t=11.73\ kg/\Delta t=23.46\ lC_3/\Delta t \quad (20)$$

This volume of liquid solvent is delivered, in a time interval Δt, by the solvent make-up pump (86 in FIG. 1 and 6) into the solvent injector, vapourized and mixed with 0.4551 $m^3|_{10.45\ MPa}$ of tail gas to make up 1 $m^3|_{10.45\ MPa}$ startup injection gas with composition given by Eq.(5) and volume by Eq.(16).

2. Steady-State Injection

At this stage the solvent vapour chamber (134, FIG. 2*b*) has been established and the reservoir produces at a steady rate. The mobilized oil contains solvent mass-transferred from the injection gas and the gas chromatograph (58, FIG. 1 and 9) indicates that about a half of the injected saturated propane vapour had been consumed and must be replenished. The molar ratio of methane and propane in the depleted tail gas had been reduced to:

$$C_1:C_3=95\ mol\ \%\ C_1:5\ mol\ \%\ C_3 \quad (21)$$

The venturi meter (64, FIG. 1 and 9) indicates that the tail gas volumetric flow rate is maintained at $Q_{TG}$=1 $m^3/\Delta t$. Assuming ideal behaviour, the partial pressures $\bar{p}_i$ of methane and propane in the tail gas are (sub ss=steady state):

$$\bar{p}_{C1ss}=10.432\ MPa\cdot 0.95=9.910\ Mpa \quad (22)$$

$$\bar{p}_{C3ss}=10.432\ MPa\cdot 0.05=0.522\ Mpa \quad (23)$$

a. Tail Gas Solvent Replenishment

The molar volume of methane gas and propane vapour at their partial pressures and $T_R$=32° C. and the molar volume $V_{TG}$ of the tail gas are:

$$V_{c1ss}=221.9\ cm^3/mol\ C_1|_{9.910\ MPa} \quad (24)$$

$$V_{c3ss}=4,223\ cm^3/mol\ C_3|_{0.552\ MPa} \quad (25)$$

$$V_{TG}=(0.95\cdot 221.9)\text{cm}^3/\text{mol } C_1+(0.05\cdot 4,223)\text{cm}^3/\text{mol } C_3=210.8+211.2\ V_{TG}=422.0\ \text{cm}^3/\text{mol } (C_1+C_3)|_{10.43\ Mpa} \quad (26)$$

and the total number of moles in 1 $m^3$ of tail gas at 10.43 MPa then is $$n=10^6\ \text{cm}^3/V_{TG}=10^6\ \text{cm}^3/422.0\ \text{cm}^3/\text{mol of mixture}$$

$$n=2,369.7\ \text{mol of mixture} \quad (27)$$

Of this amount, 95 mole percent is methane and 5 mole percent is propane. The mass flow rate of propane in the tail gas is $$\dot{Q}_{3ss}=0.05\cdot 2,369.7\ \text{mol}/\Delta t=118.5\ \text{mol } C_3/\Delta t \quad (28)$$

The amount of propane that must be added to the tail gas to bring it up to the injection gas dew-point composition given by Eq.(5) is the difference between Eqs. (13) and (28), ie.

$$\dot{Q}_{C3s}-\dot{Q}_{C3ss}=(265.93-118.5)\ \text{mol } C_3/\Delta t=147.4\ \text{mol } C_3/\Delta t=13.0\ \text{l}C_3/\Delta t \quad (29)$$

b. Solvent Internal Recycling and Injection Gas Makeup

The solvent is circulated through the reservoir and surface facilities both as a dissolved liquid in oil (solution 'gas') and as a saturated solvent vapour (free 'gas'). The gases are transported to the surface, the solution gas is liberated from the swelled oil in a stripper and both gases are reinjected into the formation. The function of the solution gas is to dissolve in the reservoir oil, dilute it and mobilize it. The dissolving solvent vapour releases latent heat of vaporization, warming the vapour-oil interface a few degrees in the process. The function of the free gas is to maintain the largest concentration gradient of propane pressure (or propane partial pressure in RASD) to maintain the solvent diffusion process effective.

For a given oil production rate, the circulated amount of solvent in the reservoir is approximately constant since the quantity of solvent in the draining liquid is approximately constant. This quantity is about the same both for the Simple and RASD-Vapex. Without recycling its value is about 0.5 $tC_3$/t oil, with recycling this amount decreases to about 0.06 to 0.16 $tC_3$/t oil, ie. for a 100 $m^3$/d oil production the internal recycling is about 6–16 $tC^3$/t oil. The amount of recycled solvent from the stripper added to the tail gas is thus fairly constant and constitutes a major portion (≈85%) of the total injection gas.

The remaining propane in the injection gas is a makeup which stays in the reservoir to replace, volume for volume, the produced oil drained from the growing vapour chamber. In contrast to the recycled gas, the makeup accumulates in the reservoir over the duration of the project, growing in quantity in proportion to the volume of liquids produced. To maintain the reservoir volume balance, the volume of tail gas produced is smaller than volume of gas injected by the volume of liquids produced.

i. Simple Vapex

This situation can be illustrated considering a 265 ft deep reservoir producing solvent-free oil at a rate 100 $m^3$/d (628 bbl/d) in which the volume of produced oil is replaced with makeup consisting of saturated propane vapour (FIG. 10*i*).

$P_R$=128 psia $T_R$=22° C.

$\rho_{C3(v)}$=18.64 kg/$m^3$ at $P_R$ and $T_R$

Solvent recycle=(0.06–0.16 $tC_3$/t oil)·100 t oil/d=6–16 $tC_3$(v)/d

Makeup propane=(100 $m^3$/d)·(18.64 kg/$m^3$)=1864 kg$C_3$/d=1.86 $tC_3$(v)/d

Using these numbers, at the end of a 7.365 year long project recovering 268,822 tonnes (1,690,708 bbl) of oil, the reservoir contains 5,000 tonnes of makeup propane and about 16 tonnes of recycled propane for a total of about 5,016 tonnes.

ii. Reservoir Adjusted Solvent Dewpoint—RASD-Vapex

Solvent dewpoint adjusted for a 2,000 ft deep reservoir is illustrated below using Eqs. 1–16 for $T_r$=25° C. and $P_r$=6 MPa (870 psia).

Propane vapour pressure at 25° C. 0.957 MPa is set equal to the partial pressure and the required propane vapour concentration $y_{C3}$ is $$y_{C3}=0.957\ \text{MPa}/6\ \text{MPa}=0.16$$

The injection gas composition then is $C_1$:$C_3$=84 mol %:16 mol %. If a steady state solvent-free oil production from the pattern is 100 $m^3$/d, Recycled propane=(0.06 to 0.16 t $C_3$/t oil)·(100 t oil/d)=6–16 t $C_3$/d. This amount of propane is a part of the injection gas of composition defined above.

MAKEUP PROPANE $$\bar{p}_{C3}=0.957\ \text{MPa}\Longrightarrow\text{molar volume } V_{C3}=2172.0\ \text{cm}^3/\text{mol } C_3|_{0.957\ MPa}$$

$$\bar{p}_{C1}=5.043\ \text{MPa}\Longrightarrow\text{molar volume } V_{C1}=449.3\ \text{cm}^3/\text{mol } C_1/|_{5.043\ MPa}$$

Molar volume of ideal gas binary mixture $C_1$+$C_3$ is $V_{C1+C3}$=[(0.84·449.3)+(0.16·2,172.0)] $cm^3$/mol=724.932 $cm^3$/mol at 6 MPa Consider 1 $m^3$ o f the binary mixture at 6 MPa and 25° C. The total number of moles in the mixture is:

n=$10^6$ $cm^3$/(724.932 $cm^3$/mol mixture)=1,379.44 mol of mixture, out of which 84% or 1,158.73 moles is $C_1$, and 16% or 220.71 moles is $C_3$.

The partial volumes of $C_1$ and $C_3$ are $$\bar{v}_{c1}=1,158.73\ \text{mol } C_1\cdot 449.29\ \text{cm}^3/\text{mol}C_1=0.5206\ \text{m}^3|_{5.043\ MPa}$$

$$\bar{v}_{C3}=220.71\ \text{mol } C_3\cdot 2,172.04\ \text{cm}^3/\text{mol}C_3=0.4794\ \text{m}^3|_{0.957\ MPa}$$

$$V_{IG}=\bar{v}_{c1}+\bar{v}_{C3}=0.5206\ \text{m}^3+0.4794\ \text{m}^3=1.0000\ \text{m}^3|_{6\ MPa}$$

Makeup injection gas replaces solvent-free oil production 100 $m^3$/d to maintain reservoir volume balance.

$$52.06\ \text{m}^3\ C_1|_{5.043\ MPa}+47.94\ \text{m}^3C_3|_{0.957\ MPa}=100\ \text{m}^3|_6\ \text{MPa}$$

If the densities at 25° C. are $\rho_{C1}|_{5.043}$ MPa≈35.0 kg/$m^3$ and $\rho_{C3}|_{0.960\ MPa}$≈20.0 kg/$m^3$, then 35.0 kg/$m^3C_1$·52.06 $m^3C_1$+20.0 kg/$m^3C_3$·47.95 $m^3C_3$ and the mass $M_{IG}$ of the makeup injection gas per day is $M_{IG}$=1,822.1 kg $C_1$+959.0 kg $C_3$=2,781 kg $C_1$+$C_3$ mixture.

In a 2,000 ft reservoir the $C_3$ in the makeup injection gas is about one half (0.959 t/1.86 t·100=52%) of that for Simple Vapex. This improves the economy of the process greatly. The same rate of production as in Simple Vapex is achieved by employing a larger recovery pattern. Using these numbers, at the end of a 7.365 year long project recovering 268,822 tonnes (1,690,708 bbl) of oil, the reservoir contains 2,580 tonnes of makeup propane and about 16 tonnes of recycled propane for a total of about 2,596 tonnes. The situation is illustrated in FIG. 10*ii*. These rough guidelines for the two cases are summarized in the following table.

Basis: Solvent-free oil production from the recovery pattern=100 $m^3$/d (100 t/d).

| Vapex | | |
|---|---|---|
| Type | Simple | Reservoir Adjusted Solvent Dewpoint |
| $P_R$ (psia) | 128 | 870 |
| Depth (ft) | 265 | 2,000 |
| $T_R$ (° C.) | 22 | 25 |
| $C_3$ circulation rate (t/d) | 6–16 | 6–16 |
| $C_3$ makeup (t/d) | ≈2 | ≈1 |
| Makeup accumulated after 7.365 years (t) | 5,000 | 2,580 |

In Simple Vapex the solvent makeup is about 2 tonnes $C_3$ per 100 tonnes of oil or 2% w/w. On a volume basis 1 bbl $C_3$(l) replaces 25 bbl produced oil (4% v/v). The saturated vapour occupies voids vacated in the pore space of the rock matrix by the drained oil.

In the RASD process the solvent makeup is about a half of that required in Simple Vapex because of the dilution effect of the dewpoint adjusting gas ($C_1$). In round numbers, the solvent makeup is about 1 tonne $C_3$/100 tonnes oil (1% w/w) or 1 bbl $C_3$(l) per 50 bbl of produced oil (2% v/v).

3. Blow-down

When the rising solvent chambers have reached the top of the reservoir, the constant production rate mechanism has come to an end. There is a bank of mobilized oil at the base of the reservoir slowly draining towards the producer, driven by the oil gravity head. At this point in time the economic life of the project is largely over. The valuable hydrocarbon solvent, which both replaces the produced oil and is dissolved in the residual reservoir oil, is recovered by gradually lowering the reservoir pressure. Practically all of the solvent is expected to be recovered for use in another project.

Thus, it is apparent that there has been provided in accordance with the invention a VAPOUR EXTRACTION OF HYDROCARBON DEPOSITS that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

| TEXT NOMENCLATURE | |
|---|---|
| bbl/d | barrel per day |
| $C_1$ | methane gas |
| $C_2$ | ethane |
| $C_3$ | propane vapour |
| $C_{3\,(l)}$ | liquid propane |
| $C_4$ | butane |
| G/O | gas-to-oil ratio |
| GOC | gas-oil contact |
| l | litre |
| MP | metering pump |
| MPa | megapascal |
| n | number of moles |
| OOIP | original oil in place |
| OWC | oil-water contact |
| $\bar{p}$ | partial pressure |
| P | total pressure |
| $P_{bar}$ | barometric pressure |
| $P_R$ | reservoir pressure |
| $P_s$ | surface facility pressure |

-continued

| TEXT NOMENCLATURE | |
|---|---|
| $P_v$ | saturated vapour pressure |
| t | time or tonne |
| t/d | tonnes per day |
| $\Delta t$ | time interval |
| $T_R$ | reservoir temperature |
| V | (molar) volume |
| $\bar{v}$ | partial volume |
| v/v | volume basis |
| $V_T$ | total volume |
| $\dot{Q}$ | mass flow rate |
| w/w | weight basis |
| y | mole fraction of vapour |
| ρ | density of oil |
| Subscripts | |
| C1 | methane gas |
| C3 | propane vapour |
| CUM | cumulative |
| IG | injection gas |
| TG | tail gas |
| i | component of a mixture |
| v | saturated vapour |
| R | reservoir |
| s | startup injection |
| ss | steady state injection |
| S | surface facility |
| T | total |

| FIGURES NOMENCLATURE | |
|---|---|
| 10 | Petroleum reservoir ($H_2O$, oil, gas) |
| 11 | |
| 12 | Hydrocarbon deposit (oil, bitumen) |
| 13 | |
| 14 | Lower boundary of deposit |
| 15 | |
| 16 | Gas cap |
| 17 | |
| 18 | Active aquifer |
| 19 | |
| 20 | Overburden |
| 21 | |
| 22 | Underburden |
| 23 | |
| 24 | Gas-oil contact |
| 25 | |
| 26 | Oil-water contact |
| 27 | |
| 28 | Worm holes |
| 29 | |
| 30 | Horizontal injection well |
| 30a | Permanent hor. inj. well (FIG. 2b) |
| 30b | Horizontal inj. well used initially as a temporary producer (FIG. 2b) |
| 31 | |
| 32 | Horizontal production well (bore hole) |
| 33 | |
| 34 | Vertical or inclined injection well |
| 35 | |
| 36 | Perforation of the well tubing |
| 37 | |
| 38 | Slotted liner in an open hole |
| 39 | |
| 40 | Pump (eg. progressive cavity pump) |
| 41 | |
| 42 | Production tubing |
| 43 | |
| 44 | Casing |
| 45 | |

-continued

| FIGURES NOMENCLATURE | |
|---|---|
| 46 | Sucker rod string |
| 47 | |
| 48 | Dryer |
| 49 | |
| 50 | Solvent stripper |
| 51 | |
| 52 | Compressor 1 |
| 53 | |
| 54 | Compressor 2 |
| 55 | |
| 56 | Compressor 3 |
| 57 | |
| 58 | Gas chromatograph 1 |
| 59 | |
| 60 | Gas chromatograph 2 |
| 61 | |
| 62 | Separator |
| 63 | |
| 64 | Flow meter |
| 65 | |
| 66 | Solvent source |
| 67 | |
| 68 | Natural gas makeup or startup storage facility |
| 69 | |
| 70 | Injection gas line |
| 71 | |
| 72 | Tail gas line (= free gas line) |
| 73 | |
| 74 | Solvent recycle line |
| 75 | |
| 76 | Solution gas line |
| 77 | |
| 78 | Natural gas line |
| 79 | |
| 80 | Storage line |
| 81 | |
| 82 | Makeup line |
| 83 | |
| 84 | Solvent metering pump 1 |
| 85 | |
| 86 | Solvent metering pump 2 |
| 87 | |
| 88 | Pressure transducer 1 |
| 89 | |
| 90 | Pressure transducer 2 |
| 91 | |
| 92 | Thermocouple 1 |
| 93 | |
| 94 | Thermocouple 2 |
| 95 | |
| 96 | Solvent injector (device for converting 106 into 108) |
| 97 | |
| 98 | Dew point check (DPX) |
| 99 | |
| 100 | Production wellhead |
| 101 | |
| 102 | Injection wellhead |
| 103 | |
| 104 | Liquid propane |
| 105 | |
| 106 | Tail gas = free gas (mostly $C_1$ with undersaturated $C_3$ vapour) |
| 107 | |
| 108 | Injection gas ($C_1$ with saturated $C_3$ vapour) |
| 109 | |
| 110 | Nozzle |
| 111 | |
| 112 | Region of lower pressure in the throat of the ventury |
| 113 | |
| 114 | Venturi |
| 115 | |
| 116 | Diffuser |
| 117 | |

-continued

| FIGURES NOMENCLATURE | |
|---|---|
| 118 | Mixing zone |
| 119 | |
| 120 | Heater coil |
| 121 | |
| 122 | Control unit/module |
| 123 | |
| 124 | Resistor wire screen ⊥ to IG flow |
| 125 | |
| 126 | Wheatstone bridge |
| 127 | |
| 128 | Pipe flange |
| 129 | |
| 130 | Blanket of solvent vapour (forming an incipient solvent chamber) |
| 131 | |
| 132 | Rising solvent vapour fingers |
| 133 | |
| 134 | Draining diluted oil |
| 135 | |
| 136 | Solvent chamber |
| 137 | |
| 138 | Solvent-free natural gas |
| 139 | |
| 140 | Arrows indicating oil flow to well 32 |
| 141 | |
| 142 | Outer limit of worm hole growth |
| 143 | |
| 144 | Produced oil, water and solution gas |
| 145 | |
| 146 | Solvent-free oil |
| 147 | |
| 148 | Stock tank |
| 149 | |
| 150 | |
| 151 | |
| 152 | |
| 153 | |
| 154 | |
| 155 | |
| 156 | |

REFERENCES

1. Butler R. M.; Mokrys I. J., 'Process and Apparatus for the Recovery of Hydro-carbons from a Hydrocarbon deposit', U.S. Pat. No. 5,407,009, issued Apr. 18, 1995 and Canadian Patent No 2,108,349, issued Aug. 27, 1996.

2. Butler R. M. and Mokrys I. J., 'A New Process (Vapex) for Recovering Heavy Oils Using Hot Water and Hydrocarbon Vapour', Journal of Canadian Petroleum Technology, Vol. 30, No. 1, 97–106, January–February 1991.

3. Butler R. M. and Mokrys I. J., 'Recovery of Heavy Oils Using Vapourized Hydro-carbon Solvents: Further Development of the Vapex Process', Journal of Canadian Petroleum Technology, Vol. 32, No. 6, 56–62, June 1993.

4. Butler R. M. and Mokrys I.J., 'Closed-Looped Extraction Method for the Recovery of Heavy oils and bitumens Underlain by Aquifers: The Vapex Process', Journal of Canadian Petroleum Technology, Vol. 37, No. 4, 41–50, April 1998.

5. Mokrys I. J. and Butler R. M., 'The Rise of Interfering Solvent Chambers: Solvent Analog Model of Steam-Assisted Gravity Drainage', Journal of Canadian Petroleum Technology, March 1993, Volume 32, No 3, pp. 26–36.

6. Mokrys I. J. and Butler R. M., 'In Situ Upgrading of Heavy Oils and Bitumen by Propane Deasphalting: The Vapex Process', SPE 25452, Production Operations Symposium, Oklahoma City, Okla., USA, Mar. 21–23, 1993.

7. Butler R. M., Mokrys I. J. and Das S. K., 'Solvent Requirement for Vapex Recovery', SPE 30293, International Heavy Oil Symposium, Calgary, Alberta, Canada, Jun. 19–21, 1995.

8. Mokrys I. J., unpublished results.

What is claimed is:

1. An improved method for the recovery of hydrocarbons from a hydrocarbon deposit comprising the steps of:

introducing a diluent gas along a predominantly horizontal injection well drilled at the base of a hydrocarbon deposit;

creating an initial communication path with a predominantly horizontal production well spaced laterally apart from the injection well;

gradually enriching the diluent gas with a hydrocarbon solvent to produce a hydrocarbon solvent vapour which is saturated at reservoir conditions;

continuously circulating the diluent gas and the saturated hydrocarbon solvent vapour through the hydrocarbon deposit; and producing mobilized hydrocarbons from the hydrocarbon deposit.

2. The method of claim 1 wherein the diluent gas is non-condensable under reservoir conditions.

3. The method of claim 2 wherein the non-condensable diluent gas has a lower solubility in the hydrocarbon deposit than the saturated hydrocarbon solvent vapour.

4. The method of claim 1 wherein the diluent gas is selected from the group consisting of methane, nitrogen and carbon dioxide.

5. The method of claim 1 wherein the diluent gas is methane.

6. The method of claim 5, wherein the methane is obtained from the hydrocarbon deposit.

7. The method of claim 1 in which the hydrocarbon deposit is selected from the group consisting of a heavy oil and a bitumen deposit.

8. The method of claim 2 wherein the non-condensable diluent gas and the saturated solvent vapour constitute an injection gas.

9. The method of claim 1 wherein the production of mobilized hydrocarbons is accompanied by the production of a spent tail gas.

10. The method according to claim 1 wherein the tail gas comprises injection gas partially depleted of hydrocarbon solvent.

11. The method according to claim 1 in which the mobilized hydrocarbons that are removed from the deposit are replaced volume for volume with injection gas.

12. The method of claim 1 in which the tail gas is converted back into injection gas by enriching it with a variable amount of hydrocarbon solvent.

13. The method of claim 1 wherein the solvent vapour in the injection gas is maintained saturated at or near its dew point.

14. The method of claim 1 wherein the dew point of the solvent vapour in the injection gas is adjusted to the downhole conditions by employing a solvent injector to continuously add solvent to the tail gas.

15. The method of claim 1 wherein the injection gas is continuously circulated through the hydrocarbon deposit to establish and enlarge solvent vapour chambers to facilitate mobilization and leaching of heavy oil or bitumen.

16. The method of claim 1 wherein the solvent vapour saturation within the injection gas is monitored and adjusted, based upon an output signal from a dew-point-check device.

17. The method of claim 1 further including circulating excess solvent as free gas through the hydrocarbon deposit.

18. The method of claim 1 wherein the hydrocarbon solvent is selected from the group consisting of ethane, propane and butane.

19. The method of claim 1 wherein the hydrocarbon solvent is propane.

20. The method of claim 1 in which the gases are dry.

21. The method of claim 1 wherein an initial communication path between the injection and production wells is established substantially along the whole length of the two wells.

22. The method of claim 1 wherein a planar well is formed between the horizontal injection and the horizontal production wells.

23. The method of claim 22 wherein the planar well is a well that creates an extensive vapour-oil contact area.

24. The method of claim 1 wherein the hydrocarbon deposit has a pre-existing high permeability zone underlying its base.

25. The method of claim 24 wherein the high permeability zone is selected from the group consisting of a pre-existing active aquifer, passive aquifer, remnant cold production channels, and a hydraulic fracture.

26. The method of claim 24 further including the step of initially creating a high permeability zone at the base of the hydrocarbon deposit by hydraulic fracturing of the hydrocarbon deposit to establish a horizontal fracture in the hydrocarbon deposit.

27. The method of claim 1 further including the step of initially subjecting the deposit to cold production to create a network of interconnected channels in the deposit to receive the hydrocarbon solvent.

28. The method of claim 1 wherein the injection gas is introduced along an array of predominantly horizontal wells spaced laterally from each other and the mobilized hydrocarbons are produced along an array of horizontal production wells.

29. The method of claim 28 wherein the production and injection wells alternate.

30. The method of claim 1 wherein the natural reservoir pressure between the injection and production wells may be increased to recess the aquifer in order to control or eliminate water production.

31. The method of claim 1 wherein the mobilized hydrocarbons are heavy oil or bitumen and are transported to the surface.

32. The method of claim 31 wherein the transport mechanism comprises a downhole pump or gas lift from spent tail gas circulation.

33. The method of claims 23 wherein an injection well comprises a line of vertical wells from cold production which are flanked by two horizontal production wells.

* * * * *